US011560263B2

(12) United States Patent
Wilson

(10) Patent No.: US 11,560,263 B2
(45) Date of Patent: Jan. 24, 2023

(54) LID ASSEMBLY FOR A FLUID VESSEL

(71) Applicant: OLYMPIA TOOLS INTERNATIONAL, INC., Covina, CA (US)

(72) Inventor: Cecil Wilson, Sanford, NC (US)

(73) Assignee: Olympia Tools International, Inc., Covina, CA (US)

( * ) Notice: Subject to any disclaimer, the term of this patent is extended or adjusted under 35 U.S.C. 154(b) by 180 days.

(21) Appl. No.: 17/157,279

(22) Filed: Jan. 25, 2021

(65) Prior Publication Data

US 2022/0234794 A1 Jul. 28, 2022

(51) Int. Cl.
*B65D 47/24* (2006.01)
*A47G 19/22* (2006.01)

(52) U.S. Cl.
CPC ..... *B65D 47/246* (2013.01); *A47G 19/2272* (2013.01); *B65D 2543/00046* (2013.01); *B65D 2543/00092* (2013.01); *B65D 2547/063* (2013.01)

(58) Field of Classification Search
CPC ..... A47G 19/2272; B65D 2543/00046; B65D 2543/00092; B65D 2547/063; B65D 47/245; B65D 47/246
USPC ..... 215/200
See application file for complete search history.

(56) References Cited

U.S. PATENT DOCUMENTS

| | | | | |
|---|---|---|---|---|
| D827,377 | S | 9/2018 | Silsby et al. | |
| 10,518,944 | B2 | 12/2019 | Choltco-Devlin | |
| 2014/0197170 | A1* | 7/2014 | Carlile | B65D 47/249 220/262 |
| 2015/0060448 | A1* | 3/2015 | Coon | A45F 3/18 220/254.1 |
| 2015/0201776 | A1* | 7/2015 | Elsaden | A47G 19/2272 220/715 |
| 2015/0344199 | A1* | 12/2015 | Chiou | B65D 47/248 220/254.1 |
| 2018/0215514 | A1* | 8/2018 | Wodka | B65D 47/32 |
| 2018/0244441 | A1* | 8/2018 | Wodka | A47G 19/2272 |
| 2019/0210773 | A1* | 7/2019 | Huang | B65D 43/26 |
| 2020/0377272 | A1* | 12/2020 | Ma | B65D 47/286 |

* cited by examiner

*Primary Examiner* — James N Smalley
*Assistant Examiner* — Madison L Poos
(74) *Attorney, Agent, or Firm* — Patterson + Sheridan, LLP

(57) ABSTRACT

A valve for a lid of a fluid vessel includes a valve body having an adapter portion coupling first and second opposite ends of the valve body. The first and second ends are rotatably fixed to each other and have an angle formed therebetween. The adapter portion is configured to be rotatably coupled to the lid about a first axis. The first end of the valve body is configured to be coupled to a button for rotating the first end about the first axis. The valve includes a stopper coupled to the second end of the valve body and configured to cover an opening in the lid. The stopper is configured to be separated from the opening when the first end of the valve body is rotated in a first direction about the first axis.

20 Claims, 6 Drawing Sheets

LID ASSEMBLY FOR A FLUID VESSEL

BACKGROUND

Embodiments described herein generally relate to a lid assembly for a fluid vessel, more particularly, embodiments relate to a lid assembly having a rotatable valve.

Many fluid vessels are insulated to help maintain the desired temperature of fluid stored inside. Such fluid vessels often have a removable lid to help with filling, emptying, and cleaning inside. Such fluid vessels often have an opening in the lid for drinking or pouring. Fluid communication through the opening in the lid may be regulated by a sealing assembly. The sealing assembly may be opened only for drinking or pouring but otherwise closed to limit undesirable thermal convection through the opening. Certain existing sealing assemblies are overly complex, costly to fabricate and are not removable from the lid making cleaning difficult. Embodiments of the present disclosure address at least some of these shortcomings.

SUMMARY

Embodiments of the present disclosure generally relate to a lid assembly for a fluid vessel, more particularly, embodiments relate to a lid assembly having a rotatable valve.

Embodiments of the present disclosure relate to a valve for a lid of a fluid vessel. The valve includes a valve body having an adapter portion coupling first and second opposite ends of the valve body. The first and second ends are rotatably fixed to each other and have an angle formed therebetween. The adapter portion is configured to be rotatably coupled to the lid about a first axis. The first end of the valve body is configured to be coupled to a button for rotating the first end about the first axis. The valve includes a stopper coupled to the second end of the valve body and configured to cover an opening in the lid. The stopper is configured to be separated from the opening when the first end of the valve body is rotated in a first direction about the first axis.

Embodiments of the present disclosure relate to a lid assembly for removable attachment to a fluid vessel. The lid assembly includes a lid body having an opening, a button assembly coupled to the lid body, and a valve. The valve includes a valve body having an adapter portion coupling first and second opposite ends of the valve body. The first and second ends are rotatably fixed to each other and have an angle formed therebetween. The adapter portion is configured to be rotatably coupled to the lid body about a first axis. The first end of the valve body is configured to be coupled to the button assembly for rotating the first end about the first axis. The valve includes a stopper coupled to the second end of the valve body and configured to cover the opening in the lid body. The stopper is configured to be separated from the opening when the first end of the valve body is rotated in a first direction about the first axis.

Embodiments of the present disclosure relate to a valve for a lid of a fluid vessel. The valve includes a valve body configured to be rotatably coupled to the lid about a first axis. A first end of the valve body is configured to be coupled to a button for rotating the valve body about the first axis. The valve includes a stopper coupled to a second end of the valve body and configured to cover an opening in the lid. The stopper is configured to be separated from the opening when the first end of the valve body is rotated by the button about the first axis.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments described herein generally relate to a lid assembly for a fluid vessel, more particularly, embodiments relate to a lid assembly having a rotatable valve. Valve embodiments of the present disclosure are simpler in design, less expensive to fabricate and are removable from the lid assembly making cleaning easier.

Figure 1A:
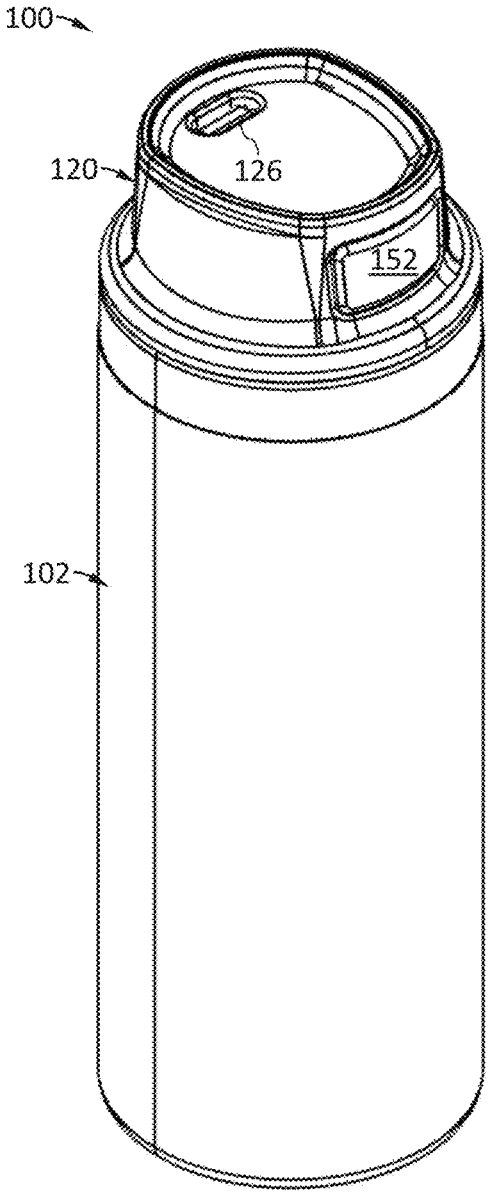
FIG. 1A is a top isometric view of an exemplary fluid vessel, according to one or more embodiments.

FIG. 1A is a top isometric view of an exemplary fluid vessel 100. The fluid vessel 100 generally includes a lid assembly 120 removably attached to a fluid vessel body 102. In some embodiments, the fluid vessel body 102 and/or the lid assembly 120 are insulated (e.g., double-wall vacuum insulated) to help maintain the desired temperature of fluid stored inside the fluid vessel 100. The lid assembly 120 is removable to help with filling, emptying, and cleaning inside the fluid vessel body 102. The lid assembly 120 has an opening 126 for drinking or pouring. Fluid communication through the opening 126 in the lid assembly 120 is regulated by a valve which is shown in FIGS. 3A-3D and described in more detail below. In some embodiments, the valve may be opened only for drinking or pouring but otherwise closed to limit undesirable thermal convection through the opening 126. The valve is moved to the open position by depressing a button 152 further shown in FIGS. 2A-2D and described in more detail below.

Figure 1B:
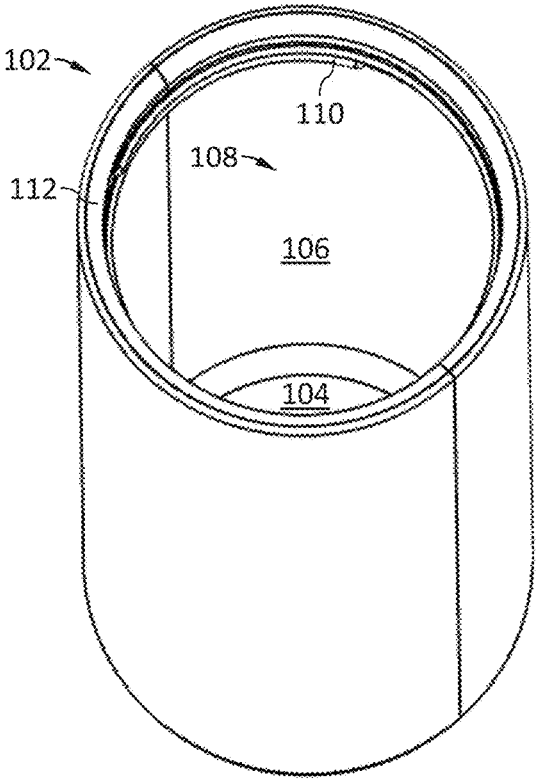
FIG. 1B is an isolated top isometric view of a fluid vessel body of FIG. 1A.

FIG. 1B is an isolated top isometric view of the fluid vessel body 102 of FIG. 1A. The fluid vessel body 102 generally includes a bottom portion 104 at a distal end and a sidewall portion 106 extending from the bottom portion 104 in a proximal direction in relation to the fluid vessel body 102. The sidewall portion 106 radially surrounds a cavity 108 which is open at a proximal end opposite the bottom portion 104 of the fluid vessel body 102. An inner diameter of the sidewall portion 106 facing the cavity 108 includes a profile, such as threaded portion 110, for removably attaching the lid assembly 120 to the fluid vessel body 102.

Figure 1C:
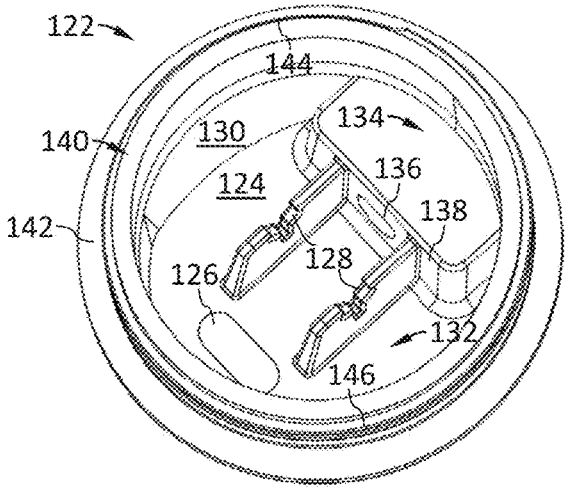
FIG. 1C is an isolated bottom isometric view of a lid body of FIG. 1A.

FIG. 1C is an isolated bottom isometric view of a lid body 122 of the lid assembly 120 of FIG. 1A. The lid body 122 has a cover portion 124 at a proximal end and an opening 126 formed through the cover portion 124. A bottom side of the cover portion 124 of the lid body 122 has a pair of grooves 128 facing in a distal direction in relation to the lid body 122. The pair of grooves 128 are configured to receive a corresponding adapter portion of a valve body to removably couple the valve to the lid body 122 as described in more detail below. The lid body 122 has a sidewall portion 130 extending from the cover portion 124 in the distal direction in relation to the lid body 122 and radially surrounding a cavity 132 of the lid body 122. A recess 134 is formed in the sidewall portion 130 of the lid body 122 for housing the button 152 as shown in FIGS. 2A-2D and described in more detail below. A port 136 is formed through a wall 138 of the recess 134 so that a button catch 160 coupled to the button 152 can extend into the cavity 132 of the lid body 122 as shown in FIGS. 2C-2D and described in more detail below.

The lid body 122 has an annular base portion 140 extending from the sidewall portion 130 in the distal direction in relation to the lid body 122. The annular base portion 140 has a flange 142 configured to sealingly engage a top face 112 (shown in FIG. 1B) of the fluid vessel body 102. Although not shown, a lid gasket is used to effect an air- and fluid-tight seal between the flange 140 and the top face 112 when the lid body 122 is attached to the fluid vessel body 102. The annular base portion 140 has an outer diameter 144 extending from the flange 140 in the distal direction in relation to the lid body 122. The outer diameter 144 has a profile, such as threaded portion 146, corresponding to and engaging with the threaded portion 110 of the fluid vessel body 102.

Figure 2A:
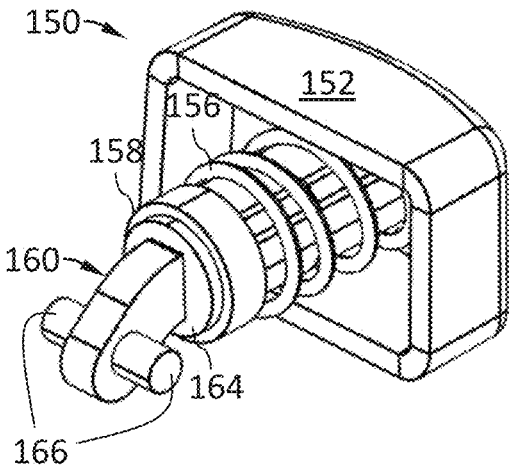
FIGS. 2A-2B are assembled and exploded isolated bottom isometric views, respectively, of a button assembly which may be housed within the lid body of FIG. 1C.
Figure 2B:
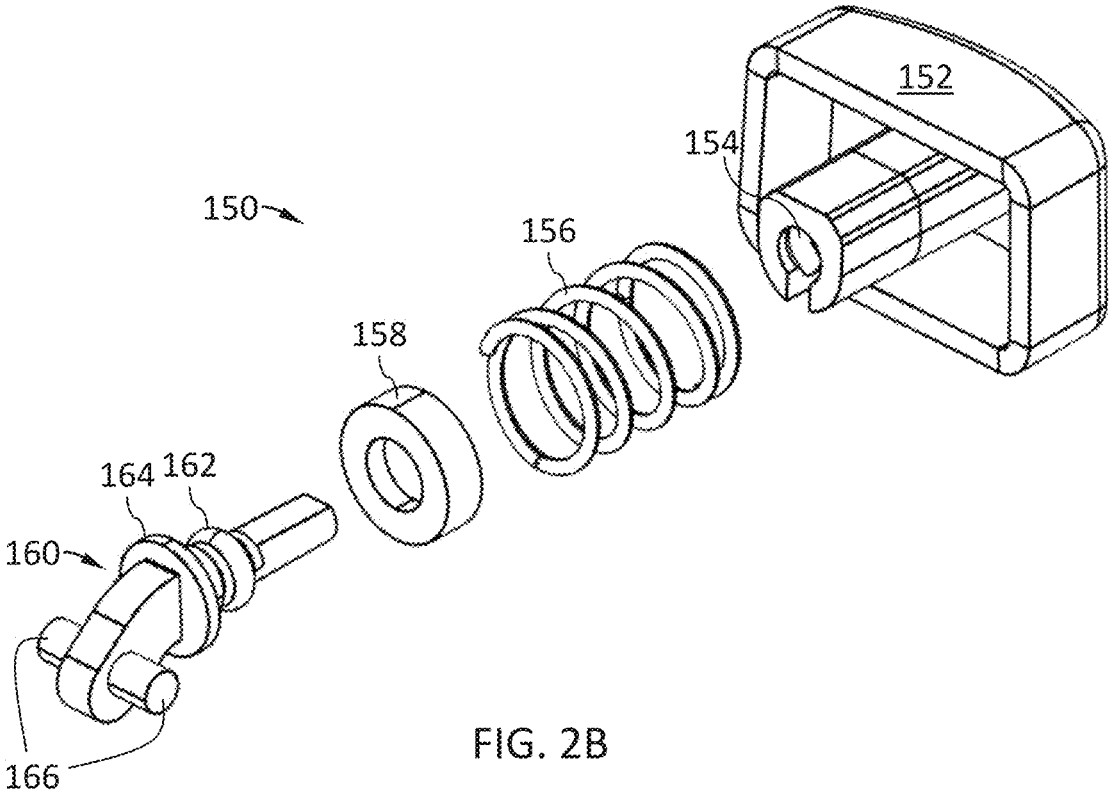
Figure 2C:
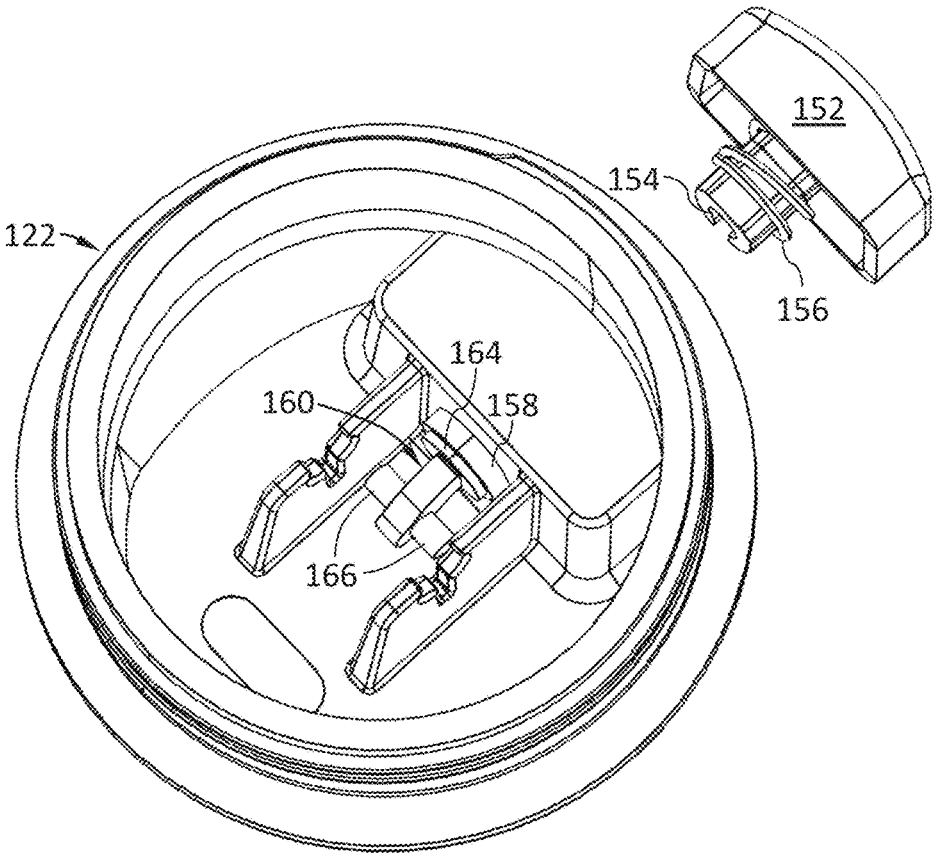
FIG. 2C is a bottom isometric view of the lid body of FIG. 1C showing a portion of the button assembly assembled therewith.
Figure 2D:
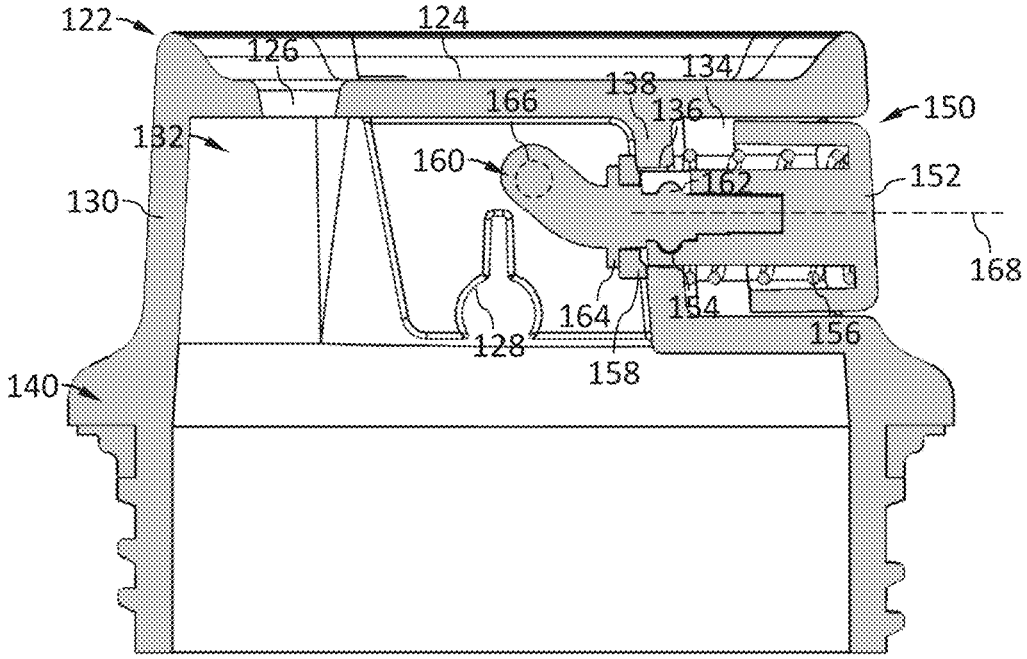
FIG. 2D is a partial cross-sectional view of the lid body of FIG. 1C showing the button assembly assembled therewith in its entirety.

FIGS. 2A-2B are assembled and exploded isolated bottom isometric views, respectively, of a button assembly 150 which may be housed within the lid body 122 of FIG. 1C. The button assembly 150 is inverted in FIGS. 2A-2B compared to FIG. 2D. FIG. 2C is a bottom isometric view of the lid body 122 of FIG. 1C showing a portion of the button assembly 150 assembled therewith. FIG. 2D is a partial cross-sectional view of the lid body 122 of FIG. 1C showing the button assembly 150 assembled therewith in its entirety. FIGS. 2A-2D are, therefore, described together herein for clarity. The button assembly 150 generally includes the button 152, a biasing member, a sealing member and a button catch 160 coupled to the button 152. When the button assembly 150 is assembled with the lid body 122, the button 152 is disposed at least in part within the recess 134 formed in the sidewall portion 130 of the lid body 122 as shown in FIG. 2D. The button 152 has a notch 154 in a first end for receiving a corresponding rounded shape 162 on a first end of the button catch 160. The button catch 160 is coupled to the button 152 by press-fitting the rounded shape 162 into the notch 154. A biasing member, such as coil spring 156, is disposed between the button 152 and the wall 138 of the recess 134. The biasing member biases the button 152 away from the wall 138 of the recess 134 as shown in FIG. 2D. A sealing member, such as grommet 158 contacts an inner part of the wall 138 to effect an air- and fluid-tight seal across the port 136 when the button assembly 150 is in the biased outward position as shown in FIG. 2D. The grommet 158 is disposed around an outer diameter of the first end of the button catch 160 and secured between the first end of the button 152 and a shoulder on the button catch 160 as described in more detail below.

A second end of the button catch 160 opposite the first end extends into the cavity 132 of the lid body 122. As shown in FIG. 2D, the first end of the button catch 160 is substantially aligned with an axis 168 of the button assembly 150, whereas the second end of the button catch 160 is angled towards the proximal end of the lid body 122 with respect to the axis 168. In other words, the second end of the button catch 160 is angled more towards the cover portion 124 of the lid body 122 compared to the first end as shown in FIG. 2D. The button catch 160 has a stop ring 164 positioned between the first and second ends. The stop ring 164 and grommet 158 contact the inner part of the wall 138 as shown in FIGS. 2C-2D to define a position of the button assembly 150, including alignment of the button 152 within the recess 134, when the valve is closed and/or with the valve removed from the lid body 122. A pair of bars 166 extend from opposite sides of the second end of button catch 160 to engage a corresponding pair of cut-outs of the valve body as shown in FIG. 3D and described in more detail below.

Figure 3A:
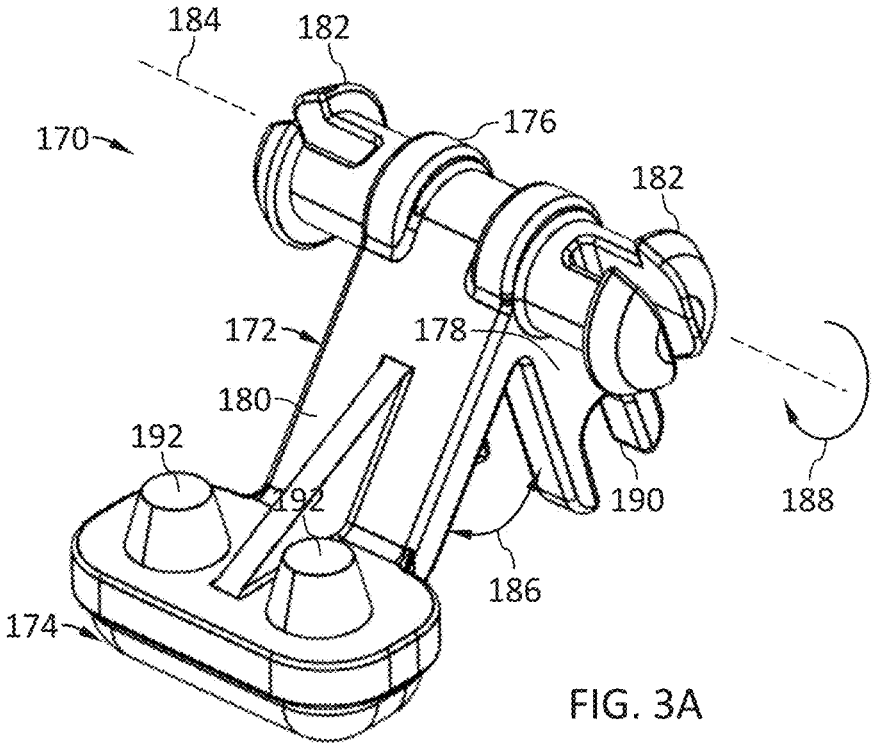
FIGS. 3A-3B are assembled and exploded isolated bottom isometric views, respectively, of a valve which may be removably coupled to a bottom side of the lid body of FIG. 1C.
Figure 3B:
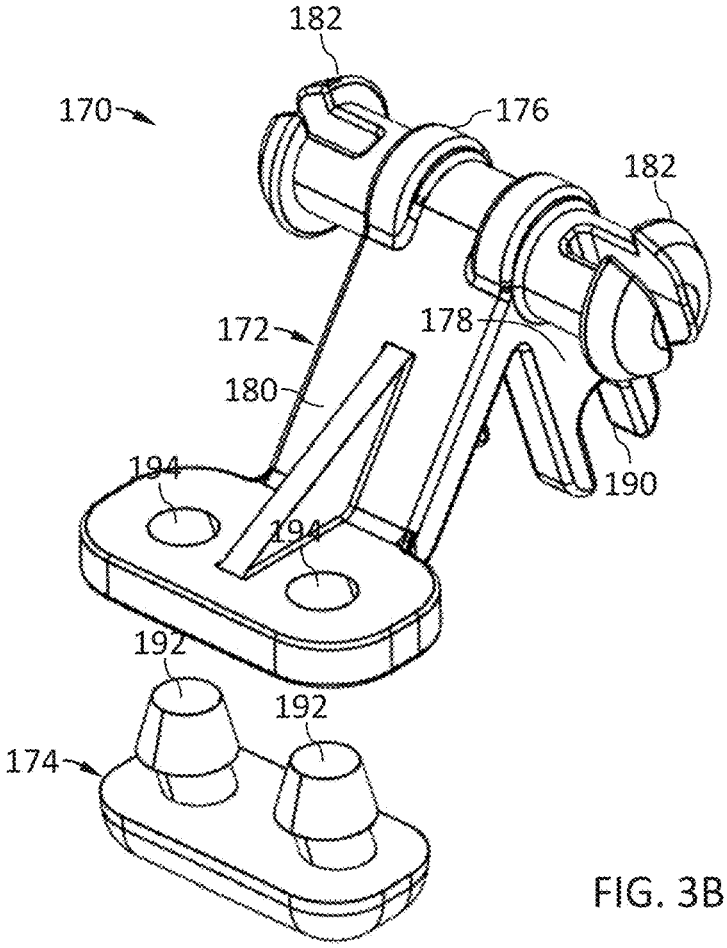
Figure 3C:
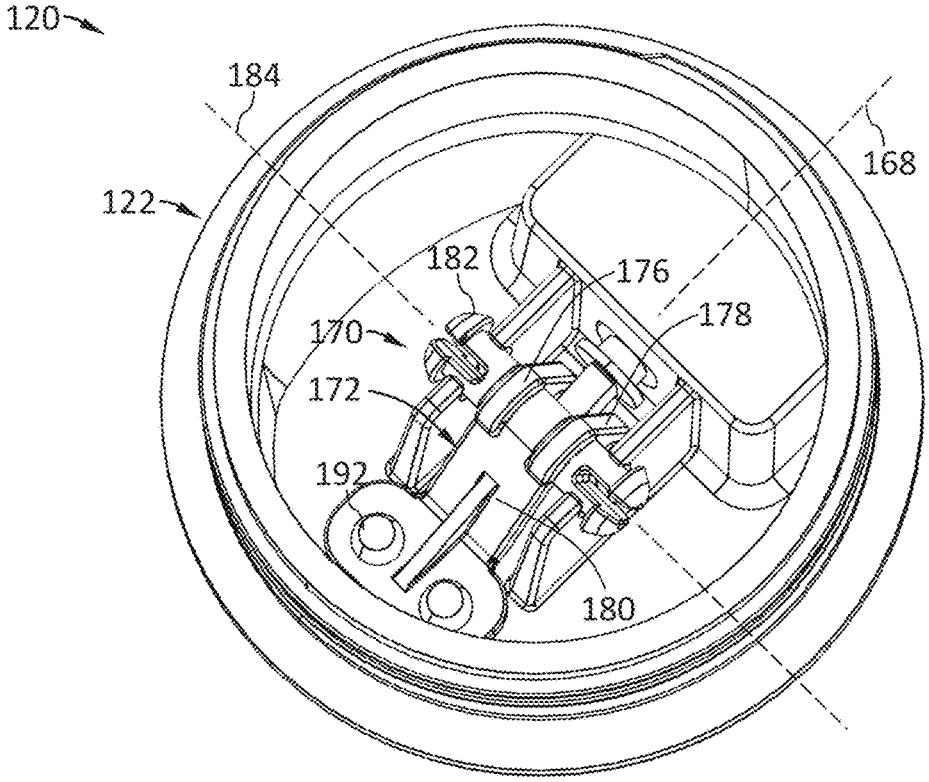
FIG. 3C is a bottom isometric view of the lid body of FIG. 2C showing the valve assembled therewith and in a closed position.
Figure 3D:
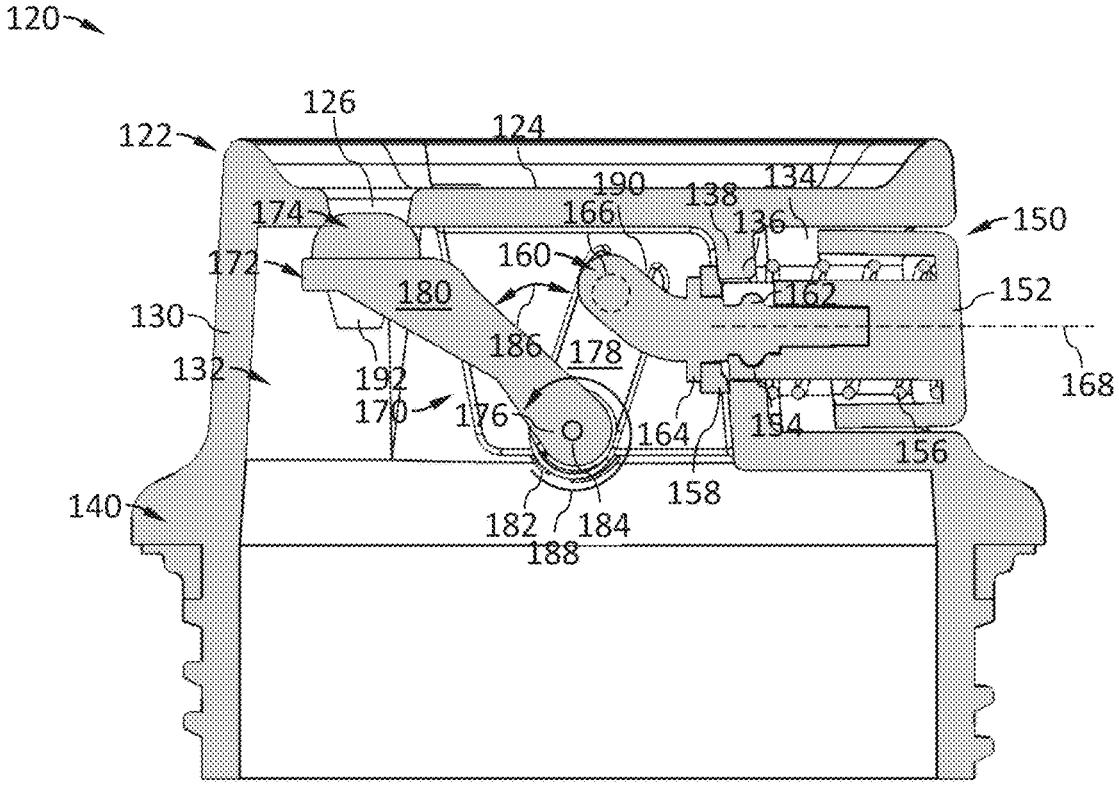
FIG. 3D is a partial cross-sectional view of FIG. 3C.

FIGS. 3A-3B are assembled and exploded isolated bottom isometric views, respectively, of a valve 170 which may be removably coupled to a bottom side of the lid body 122 of FIG. 1C. The valve 170 is inverted in FIGS. 3A-3B compared to FIG. 3D. FIG. 3C is a bottom isometric view of the lid assembly 120 showing the valve 170 assembled with the lid body 122 of FIG. 2C and in a closed position. The grommet 158 is omitted from FIG. 3C for clarity. FIG. 3D is a partial cross-sectional view of FIG. 3C. FIGS. 3A-3D are, therefore, described together herein for clarity.

The valve 170 generally includes a valve body 172 and a stopper 174 coupled to the valve body 172. The valve body 172 has an adapter portion 176 coupling a first end 178 of the valve body 172 to an opposite second end 180 of the valve body 172. In some embodiments, the valve body 172 comprises plastic and is formed by injection molding. Although the valve body 172 is shown as being integrally formed as a single piece, it is contemplated that portions of the valve body 172 may be coupled together by one or more suitable fasteners. The adapter portion 176 includes a pair of push rivets 182 which snap into a pair of corresponding grooves 128 in the lid body 122 to removably couple the valve 170 to the lid body 122 as shown in FIG. 3C. The adapter portion 176 is rotatably coupled to the lid body 122 about an axis 184 of the adapter portion 176. The axis 184 is substantially orthogonal to the axis 168 of the button assembly 150 as shown in FIGS. 3C-3D.

The first and second ends 178, 180 of the valve body 172 are rotatably fixed to each other and therefore rotate together in the same direction about the axis 184. An angle, such as acute angle 186 measured in a first direction (indicated by arrow 188) about the axis 184, is formed between the first and second ends 178, 180. In some embodiments, the angle 186 measured in the first direction 188 is about 90° or less, such as about 45° to about 90°, such as about 60° to about 75°, such as about 60°, such as about 70°. With regard to the angle 186 of the valve body 172, it is contemplated that as the angle 186 increases, the size of the cavity 132 of the lid body 122 may need to be enlarged accordingly. Therefore, the angle 186 is determined at least in part based on the size of the lid body 122 and corresponding fluid vessel 100. Although any acute angle is possible and disclosure of examples thereof are not intended to be limiting beyond the scope of the claims that follow, it is contemplated that valve bodies 172 having angles greater than about 90° may not be suitably sized and/or shaped for use with lid body embodiments disclosed herein.

In some embodiments, a length ratio of the first end 178 relative to the second end 180 is about 1:2.5 or greater, such as about 1:1.5 or less, such as about 1:2.5 to about 1:1.5, such as about 1:2. With regard to the relative lengths of the first and second ends 178, 180 of the valve body 172, it will be appreciated that as the length of the first end 178 increases in relation to the second end 180, the biasing force of the coil spring 156 needed to effect the same sealing force between the stopper 174 and the opening 126 decreases. This is because the length of first end 178 functions as a force multiplier acting on the second end 180. For example, the first end 178 may function as a positive or negative force multiplier depending on whether the first end 178 is longer or shorter, respectively, than the second end 180. Therefore, the relative lengths of the first and second ends 178, 180 of the valve body 172 are determined at least in part based on the desired biasing force of the coil spring 156 against the button 152 and/or the desired sealing force between the stopper 174 and the opening 126, which in turn affects operability of the valve 170. Although any relative length of the first and second ends 178, 180 is possible and disclosure of examples thereof are not intended to be limiting beyond the scope of the claims that follow, it is contemplated that length ratios of the first end 178 relative to the second end 180 between about 1:2.5 and about 1:1.5 may be suitable for optimum operability of valve embodiments disclosed herein.

The first end 178 of the valve body 172 has a pair of cut-outs 190 which receive and engage a pair of corresponding bars 166 of the button catch 160 for coupling the first end 178 of the valve body 172 to the button catch 160 and ultimately to the button 150 as shown in FIG. 3D. The cut-outs 190 are open at the end and have a shape which provides clearance for loosely receiving the corresponding bars 166 as the adapter portion 176 is snap-fit onto the lid body 122 and as the valve 170 is rotated. Design of the cut-outs 190 with additional clearance helps with attachment of the valve 170 to the lid body 122 and prevents jamming between the button catch 160 and the valve body 172 as described in more detail below.

The stopper 174 is coupled to the second end 180 of the valve body 172 and configured to cover the opening 126 in the cover 124 of the lid body 122 as shown in FIG. 3D. A distal portion of the second end of the valve body 174 is angled relative to a portion proximate the adapter portion 176 to align the stopper 174 flat against the bottom side of the cover portion 124 of the lid body 122 when the valve is in the closed position. In some embodiments, the stopper 174 comprises rubber, plastic, metal, or combinations thereof. The stopper 174 includes one or more connectors, such as rubber grommets 192, inserted through corresponding apertures 194 in the second end 180 of the valve body 172. Although a pair of rubber grommets 192 and a corresponding pair of apertures 194 are shown, the valve 170 is not particularly limited to the illustrated embodiments. For example, it is contemplated that one or more grommets comprising rubber or plastic and one or more corresponding apertures may be used. Although the stopper 174 is shown as being coupled to the valve body 172, it is contemplated that the stopper 174 and the valve body 172 may be integrally formed as a single piece such as, for example, by overmolding the stopper 174 onto the valve body 172.

Figure 4A:
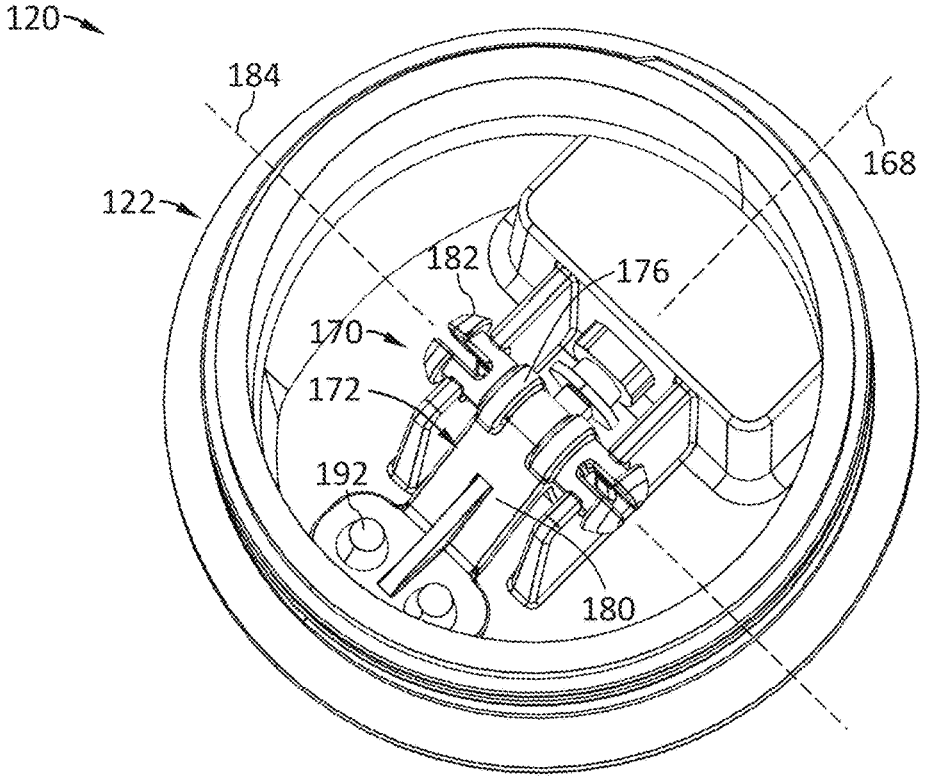
FIG. 4A is a bottom isometric view of the lid body of FIG. 3C showing the valve in an open position.
Figure 4B:
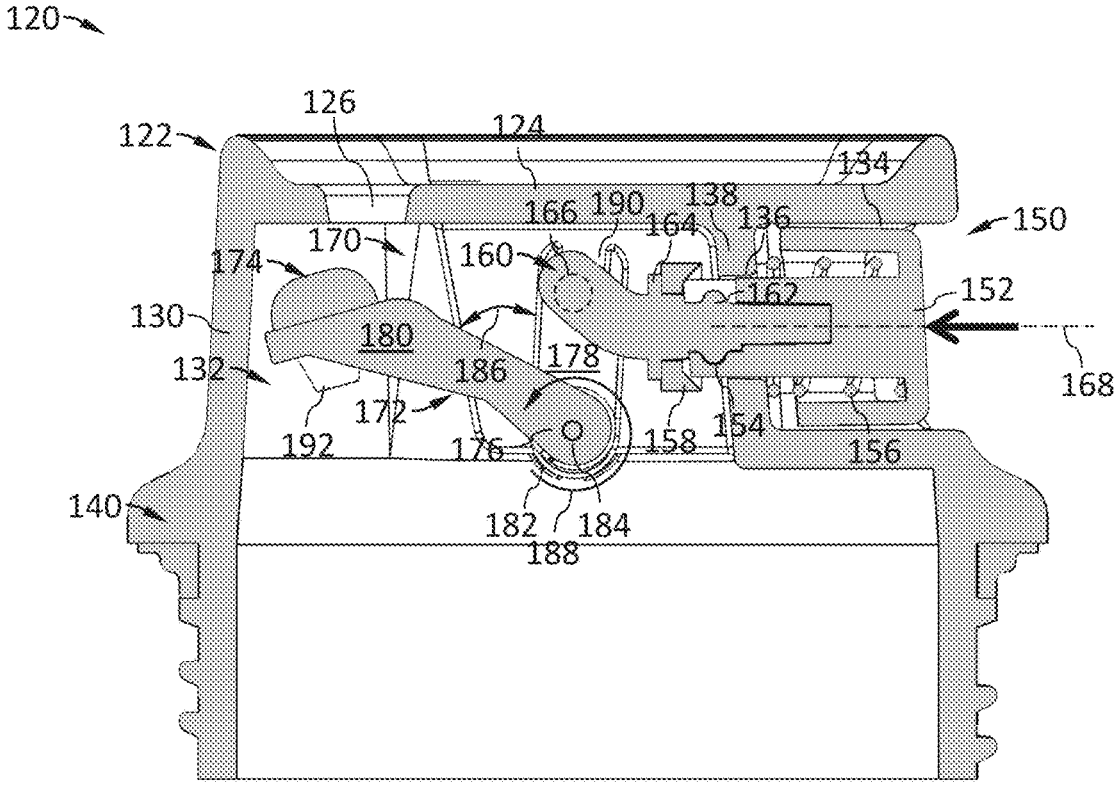
FIG. 4B is a partial cross-sectional view of FIG. 4A.

Operation of the valve 170 is described below with reference to FIGS. 3C-3D and FIGS. 4A-4B. FIG. 4A is a bottom isometric view of the lid assembly 120 of FIG. 3C showing the valve 170 in an open position. The grommet 158 is omitted from FIG. 4A for clarity. FIG. 4B is a partial cross-sectional view of FIG. 4A. FIGS. 3C-3D and FIGS. 4A-4B are, therefore, described together herein for clarity. In the closed position, the stopper 174 is in contact with the opening 126 in the cover 124 of the lid body 122 to prevent spilling fluid out of the fluid vessel 100 and to prevent undesirable thermal convection between inside and outside the fluid vessel 100. Also in the closed position, the stop ring 164 and grommet 158 are in contact with the inner part of the wall 138, and the button 152 is flush with the sidewall portion 130 of the lid body 122.

Although in the illustrated embodiments the grommet 158 only contacts and seals with the inner part of the wall 138 in the closed position, the sealing is not particularly limited to the illustrated embodiments. For example, it is contemplated that a backup seal, such as a gasket or sealing grommet, may seal from outside the lid body 122 when the button 152 is depressed. For example, a seal may be added to a part of the button 152 within the recess 134 for contacting an outer part of the wall 138 to effect an air- and fluid-tight seal across the port 136 when the valve 170 is in the open position of FIG. 4B. Alternatively, a seal may be disposed within the port 136 for slidingly and sealingly engaging the button 152 so that the port 136 of the lid body 122 is always sealed.

To move the valve 170 to the open position, the button 152 is depressed against the biasing force of the coil spring 156 which moves the button 152 along the axis 168 and towards the wall 138 of the recess 134. This moves the button catch 160 along the axis 168 and towards the valve body 172. As described earlier, the second end of the button catch 160 extends into the cavity 132 of the lid body 122 and engages the first end 178 of the valve body 172. The engagement between the bars 166 of the button catch 160 and the cut-outs 190 of the valve body 172 converts translational motion of the button catch 160 to rotational motion of the valve body 172. During rotation of the valve body 172, the distance between the bars 166 and the axis 184 changes relative to the fixed radius of rotation of the cut-outs 190. Therefore, additional clearance is provided to prevent interference between the bars 166 and the cut-outs 190. For example, in the closed position, clearance is provided between the bars 166 and the lower end of the cut-outs 190 to prevent jamming when the valve body 172 is rotated to the open position. The lower end of the cut-outs 190 are also rounded to help facilitate relative movement between the bars 166 and the cut-outs 190.

Movement of the button assembly 150 along the axis 168 in the direction of the valve body 172 causes the first end 178 of the valve body 172 to rotate in the first direction 188 about the axis 184. Because the first and second ends 178, 180 are rotatably fixed to each other, the second end 180 of the valve body 172 rotates in the first direction 188 about the axis 184 by the same rotation angle as the first end 178 thereby moving the valve 170 to the open position.

In some embodiments, during movement of the valve 170 to the open position, the rotation angle of the valve body 172 in the first direction 188 about the axis 184 is about 20° or less, such as about 10° or greater, such as about 10° to about 20°, such as about 15°. Although any rotation angle is possible and disclosure of examples thereof are not intended to be limiting beyond the scope of the claims that follow, it is contemplated that rotation angles less than about 10° may not provide adequate clearance between the stopper 174 and the opening 126 for drinking or pouring.

In some embodiments, a ratio of the stroke length of the button assembly 150 along the axis 168 to the rotation angle of the valve body 172 about the axis 184 is about ⅛ inch per 20° or greater, such as about ⅛ inch per 10° or less, such as about ⅛ inch per 20° to about ⅛ inch per 10°, such as about ⅛ inch per 15°. With regard to the length of the first end 178 of the valve body 172, it will be appreciated that as the length of the first end 178 increases, the rotation angle of the valve body 172 in the first direction 188 about the axis 184 decreases for the same stroke length of the button assembly 150. Therefore, the length of the first end 178 of the valve body 172 is determined at least in part based on the desired rotation angle of the valve body 172 and/or desired stroke length of the button assembly 150, which in turn affects operability of the valve 170. Although any ratio of stroke length to rotation angle is possible and disclosure of examples thereof are not intended to be limiting beyond the scope of the claims that follow, it is contemplated that ratios of stroke length of the button assembly 150 to rotation angle of the valve body 172 between about ⅛ inch per 20° and about ⅛ inch per 10° may be suitable for optimum operability of valve embodiments disclosed herein.

In the open position, the stopper 174 is separated from (i.e., not in contact with) the opening 126 in the cover 124 of the lid body 122 to allow drinking or pouring fluid out of the fluid vessel 100. Also in the open position, the stop ring 164 and grommet 158 are separated from the inner part of the wall 138, and the button 152 is recessed relative to the sidewall portion 130 of the lid body 122.

To return the valve 170 to the closed position, the button 152 is released allowing the biasing force of the coil spring 156 to move the button assembly 150 along the axis 168 and away from valve body 172. Movement of the button catch 160 away from the valve body 172 rotates the first and second ends 178, 180 of the valve body 172 about the axis 184 in a second direction opposite the first direction 188 to bring the stopper 174 back into contact with the opening 126.

Embodiments of the lid assembly described above offer significant advantages over and address a number of shortcomings of existing designs. For example, valve embodiments disclosed herein are simpler in design, less expensive to fabricate and are removable from the lid assembly making cleaning easier.

While the foregoing is directed to embodiments of the present disclosure, other and further embodiments of the disclosure may be devised without departing from the basic scope thereof, and the scope thereof is determined by the claims that follow.

What is claimed is:

1. A valve for a lid of a fluid vessel, the valve comprising:

a valve body having an adapter portion coupling first and second opposite ends of the valve body, the first and second ends being rotatably fixed to each other and having an angle formed therebetween, the adapter portion configured to be rotatably coupled to the lid about a first axis, wherein the first end of the valve body is configured to be coupled to a button for rotating the first end about the first axis; and a stopper coupled to the second end of the valve body and configured to cover an opening in the lid, wherein the stopper is configured to be separated from the opening when the first end of the valve body is rotated in a first direction about the first axis.

2. The valve of claim 1, wherein the valve is configured to be removably coupled to a bottom side of the lid.

3. The valve of claim 2, wherein the adapter portion comprises a pair of push rivets configured to snap into a pair of corresponding grooves in the lid to removably couple the valve to the lid.

4. The valve of claim 1, wherein the first rotational axis of the adapter portion is substantially orthogonal to a second translational axis of the button.

5. The valve of claim 1, wherein the angle formed between the first and second ends of the valve body is an acute angle measured in the first direction.

6. The valve of claim 1, wherein the stopper comprises one or more rubber grommets inserted through one or more corresponding apertures in the second end of the valve body.

7. The valve of claim 1, wherein the first and second ends of the valve body are configured to rotate in the first direction when the button is depressed, and wherein the first and second ends of the valve body are configured to rotate in a second direction opposite the first direction when the button is released.

8. The valve of claim 1, wherein the first end of the valve body comprises a pair of cut-outs configured to engage a pair of corresponding bars of a button catch for coupling the first end of the valve body to the button.

9. A lid assembly for removable attachment to a fluid vessel, the lid assembly comprising:

a lid body having an opening;

a button assembly coupled to the lid body; and a valve comprising:

a valve body having an adapter portion coupling first and second opposite ends of the valve body, the first and second ends being rotatably fixed to each other and having an angle formed therebetween, the adapter portion configured to be rotatably coupled to the lid body about a first axis, wherein the first end of the valve body is configured to be coupled to the button assembly for rotating the first end about the first axis; and a stopper coupled to the second end of the valve body and configured to cover the opening in the lid body, wherein the stopper is configured to be separated from the opening when the first end of the valve body is rotated in a first direction about the first axis.

10. The lid assembly of claim 9, wherein the lid body comprises:

a cover portion having the aperture; and a sidewall portion extending from the cover portion in a distal direction in relation to the lid body and radially surrounding a cavity of the lid body, wherein the valve is removably coupled to lid body within the cavity.

11. The lid assembly of claim 10, wherein the adapter portion comprises a pair of push rivets configured to snap into a pair of corresponding grooves in the lid body to removably couple the valve to the lid body.

12. The lid assembly of claim 10, wherein the button assembly comprises:

a button disposed at least in part within a recess formed in the sidewall portion of the lid body; and a button catch coupled to the button and extending into the cavity of the lid body, wherein the first end of the valve body comprises a pair of cut-outs configured to engage a pair of corresponding bars of the button catch for coupling the first end of the valve body to the button.

13. The lid assembly of claim 12, wherein a first end of the button catch is press-fit into a notch of the button, and wherein a second opposite end of the button catch is angled more towards the cover portion of the lid body compared to the first end.

14. The lid assembly of claim 10, wherein the lid body further comprises an annular base portion extending from the sidewall portion in the distal direction in relation to the lid body, the annular base portion having:

a flange configured to sealingly engage a top face of the fluid vessel; and an outer diameter extending from the flange in the distal direction in relation to the lid body, the outer diameter having a profile configured to engage a corresponding profile on an inner diameter of the fluid vessel for removably attaching the lid assembly to the fluid vessel.

15. A valve for a lid of a fluid vessel, the valve comprising:

a valve body configured to be rotatably coupled to the lid about a first axis, a first end of the valve body configured to be coupled to a button for rotating the valve body about the first axis; and a stopper coupled to a second end of the valve body and configured to cover an opening in the lid, wherein the stopper is configured to be separated from the opening when the first end of the valve body is rotated by the button about the first axis.

16. The valve of claim 15, wherein the valve body comprises an adapter portion aligned with the first axis and coupling the first and second ends of the valve body, the first and second ends being rotatably fixed to each other and having an angle formed therebetween, wherein the adapter portion couples the valve body to the lid.

17. The valve of claim 16, wherein the valve is configured to be removably coupled to a bottom side of the lid.

18. The valve of claim 17, wherein the adapter portion comprises a pair of push rivets configured to snap into a pair of corresponding grooves in the lid to removably couple the valve to the lid.

19. The valve of claim 16, wherein the first rotational axis of the adapter portion is substantially orthogonal to a second translational axis of the button.

20. The valve of claim 15, wherein the first end of the valve body comprises a pair of cut-outs configured to engage a pair of corresponding bars of a button catch for coupling the first end of the valve body to the button.

* * * * *